United States Patent [19]

Johnson et al.

[11] 3,978,922

[45] Sept. 7, 1976

[54] GAS STORAGE WELL SAFETY VALVE APPARATUS

[75] Inventors: Joseph L. Johnson, Houston; Shelby L. Guidry, Conroe, both of Tex.

[73] Assignee: Schlumberger Technology Corporation, New York, N.Y.

[22] Filed: Feb. 26, 1975

[21] Appl. No.: 553,348

[52] U.S. Cl. ..... 166/224 A; 137/510

[51] Int. Cl.[2] ..... E21B 43/12

[58] Field of Search ..... 166/224 A; 137/510

[56] References Cited

UNITED STATES PATENTS

| | | | |
|---|---|---|---|
| 3,126,908 | 3/1964 | Dickens | 166/224 A |
| 3,310,114 | 3/1967 | Dollison | 137/510 |
| 3,452,777 | 7/1969 | Dollison | 137/510 |
| 3,802,504 | 4/1974 | Garrett | 166/133 |
| 3,827,501 | 8/1974 | Johnson et al. | 166/224 A |
| 3,884,300 | 5/1975 | Garrett | 166/133 |

*Primary Examiner*—James A. Leppink

*Attorney, Agent, or Firm*—David L. Moseley; William R. Sherman; Stewart F. Moore

[57] ABSTRACT

In accordance with an illustrative embodiment of the present invention, a subsurface safety valve assembly that automatically closes in response to a drop in flowing pressure at the valve to a value that is below a set dome pressure, is provided with a flow restriction upstream of the valve that is sized to enable rapid closing of the safety valve in the event of disruption of surface flow lines or the like.

10 Claims, 3 Drawing Figures

GAS STORAGE WELL SAFETY VALVE APPARATUS

Figure 1:
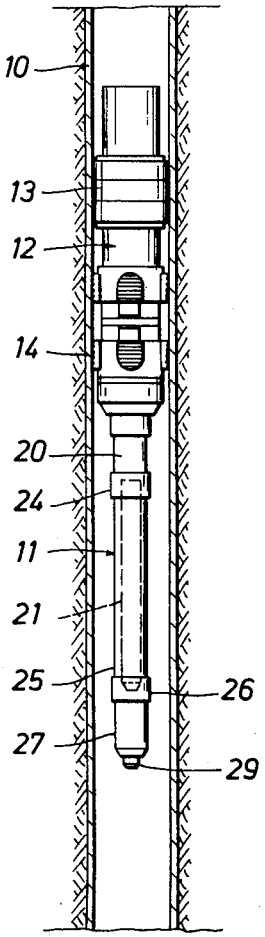

This invention relates generally to subsurface safety valves, and particularly to a safety valve for installation in a well conduit leading from an underground gas storage facility.

It is becoming more and more common to utilize depleted gas wells and other subterranean facilities for reserve storage of natural gas. The gas is piped to the location and injected through well casing into the formation and held under pressure awaiting a high demand period when it becomes necessary to withdraw the gas for commercial and residential use. All such storage facilities are either required to be, or should be, equipped with a subsurface safety valve that functions to automatically shut-in the well in case of damage or leakage of surface flow lines and valves. Otherwise disastrous consequences may ensue due to gas escaping to the atmosphere, fire and pollution of the environment.

Several of the various types of subsurface safety valves typically employed in oil wells or the like are either unsuitable or impractical for usage in gas storage wells. For example, the so-called "velocity sensitive" safety valve which automatically closes in response to an excessively high flow rate is considered unsuitable because the bottom hole pressure in a gas storage well will necessarily decline over an extended production period to the extent that at some point, even free flowing conditions would produce insufficient closing force to cause this type of valve to close. Another type of subsurface safety valve that is remotely controlled from the surface via a small control line placed outside the production string is impractical for use in storage facilities where the conduit leading to the surface is a casing string cemented in place.

Another type of safety valve in widespread use is a safety valve that closes automatically when the flowing pressure at the valve falls below a preset dome pressure. This type of valve is considered to be more reliable than a velocity sensitive valve because the valve element and control are out of the liquid flow path, and is economically more desirable than the surface controlled valve because it can be retrievably installed in an existing well conduit without a major well workover. However, in gas storage facilities where, as mentioned above, the bottom hole pressure varies over a wide range, it would be necessary to set the dome at a pressure value that is near the low end of the expected bottom hole pressure range, or else the valve would close prematurely. Moreover, with such a low setting should the surface lines and valves be disrupted causing a free flowing well condition, the gas might continue to escape for an extending period before there would be a sufficient drawdown in bottom hole pressure to cause the valve to close.

It is an object of the present invention to provide a new and improved automatic safety valve having a dome pressure control and arranged and constructed for installation in a gas storage facility.

Another object of the present invention is to provide a new and improved subsurface safety valve of the dome reference pressure type which will close rapidly in response to abnormal conditions even though there is no immediate decline in bottom hole pressure.

These and other objects are attained in accordance with the present invention through the provision of a safety valve apparatus comprising a valve body having inlet and outlet passages and a normally open valve element that automatically closes when the pressure adjacent the valve apparatus drops below a set reference pressure contained in a dome. In combination, there is provided a flow restriction means upstream of the inlet passage that is sized in such a manner that the flowing pressure at the valve drops almost immediately to a value which will cause the valve to automatically close in the well even where the bottom hole pressure remains higher than the pressure setting of the dome.

Figure 2A:
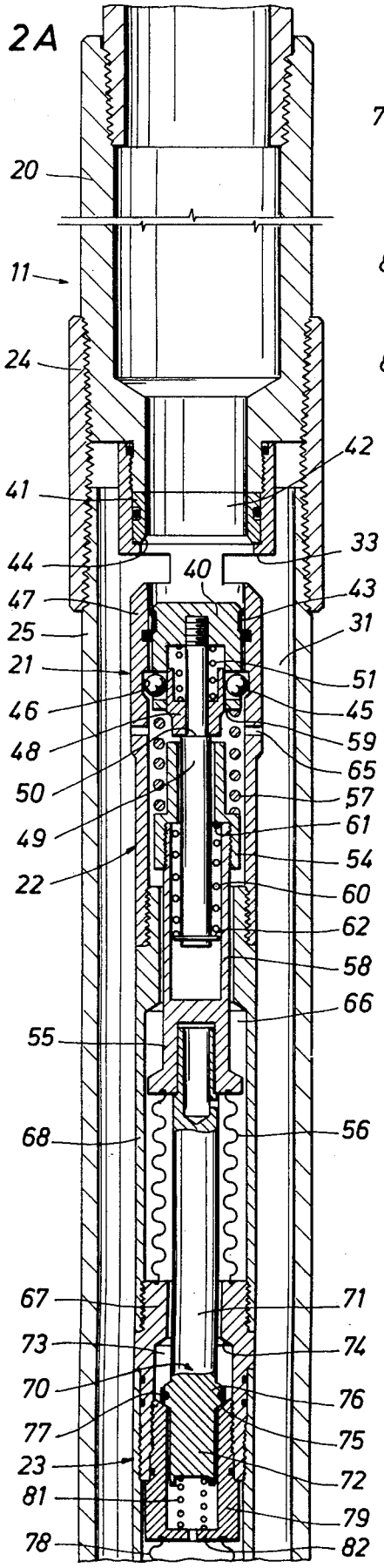
Figure 2B:
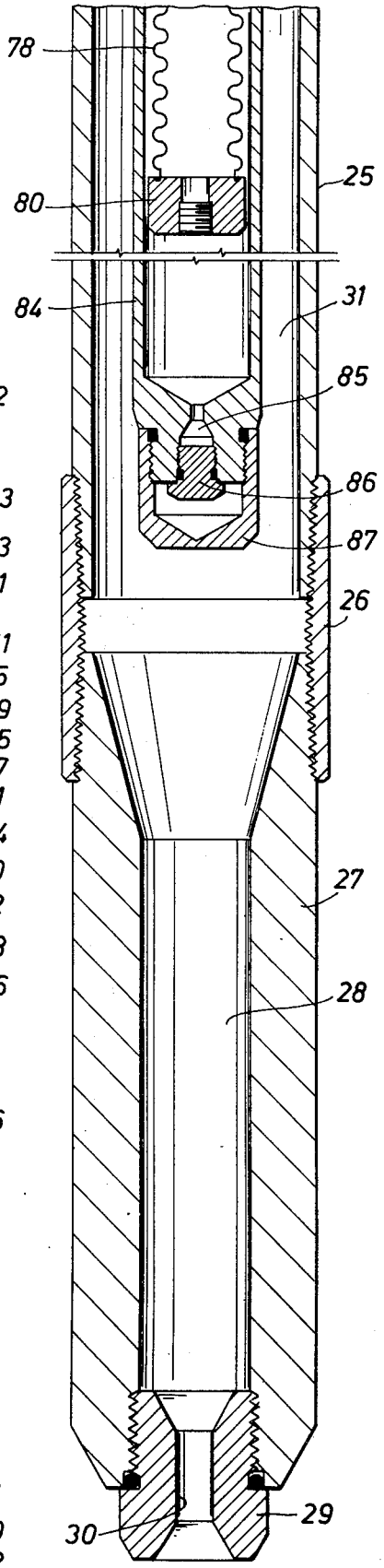

The present invention has other objects, features and advantages which will become more clearly apparent in connection with the following detailed description of a preferred embodiment, taken in conjunction with the appended drawings in which:

FIG. 1 is a schematic view of a subsurface safety valve installed in the production string of a gas storage well or reservoir; and FIGS. 2A and 2B are longitudinal sectional views with portions in side elevation of a safety valve apparatus constructed in accordance with the present invention, FIG. 2B forming a lower continuation of FIG. 2A.

Referring initially to FIG. 1, there is shown schematically a well installation, for example a gas storage well, wherein a well casing 10 extends from the surface downwardly to a subterranean reservoir containing gas. A safety valve apparatus 11 constructed in accordance with the principles of the present invention is shown attached to the lower end of a well packer 12 which sealably anchors the valve apparatus in the casing 10 at a location which preferably is just above the storage zone. The well packer 12 may be any suitable retrievable type designed to be set by a wireline, gas operated setting tool, and has elastomeric packing elements 13 that are expanded into sealing engagement with the casing 10, and normally retracted slips 14 or other anchors which contact the casing and prevent vertical movement. Other types of packers may be used so long as the total of the gas flow is constrained to pass through the safety valve apparatus 11.

The valve apparatus 11, shown in detail in FIGS. 2A and 2B, includes an upper sub 20 screwed onto the lower end of the mandrel of the packer 12 and having its lower end attached to a valve assembly indicated generally at 21. The valve assembly 21 includes a valve section 22 and a pressure sensor section 23 to be described in further detail herebelow. A threaded collar 24 couples the lower end of the sub 20 to an elongated tubular shroud or barrel 25 which extends downwardly over the valve assembly 21 and has its lower end connected by a collar 26 to a lower sub 27 having a central bore 28. A choke bean 29 is threaded to the lower end of the sub 27 and has a throat 30 through which the fluid enters. It will be recognized that the total of the fluid flowing upwardly in the casing 10 must pass through the choke bean 29 and then through the annular flow space 31 between the inner wall 32 of the shroud 25 and the external surfaces of the valve assembly 21. The fluid then passes into the inlet ports 33 of the valve section 22 and on upwardly through the packer mandrel into the pipe string 14.

The valve assembly 21 is of the type, shown in U.S. Pat. No. 3,802,504, Garrett, assigned to the assignee of this invention, which closes when flowing pressure at the valve drops below a preset dome pressure. The particular structural details of the valve assembly 21 are fully described in the aforementioned patent and form no part of the present invention. However, for purposes of completeness of this disclosure the valve assembly is shown in FIG. 2A to include an annular valve disc 40 that is movable vertically between a lower open position below the valve body inlet ports 33 and an upper closed position where the disc engages a valve seat ring 41 that surrounds a flow passage 42 leading upwardly through the sub 20. In the closed position, a compliant seal element 43 engages a downwardly and outwardly inclined surface 44 on the seat 41 in such a manner that the metal-to-metal engagement of the disc 40 and the seat 41 together with the seating of the seal element 43 against the surface 44 provide a leak-proof shut-off against upward flow.

Normally, the valve disc 40 is locked in the lower open position by a plurality of ball detents 45 that are held engaged with respect to an internal annular recess 46 on the valve body 47 by a locking sleeve 48 that is positioned behind the ball detents. The locking sleeve 48 is slidable relatively along a valve stem 49 above a shoulder 50 thereon, and is urged downwardly against the shoulder by a coil spring 51. The locking sleeve 48 is arranged to be shifted upward to a released position in response to a predetermined amount of upward movement of a tubular unlocking sleeve 54 which extends downwardly over the stem 49 and has its closed lower end portion 55 sealingly coupled to the upper end of a main bellows 56. A valve closing spring 57 reacts between an outwardly directed shoulder 58 on the sleeve 54 and a downwardly facing surface 59 on the valve disc 40 and is arranged to be compressed in response to upward movement of the unlocking sleeve 54. In addition, a recocking spring 60 is arranged to react between a downwardly facing surface 61 on the sleeve 54 and an outwardly directed shoulder 62 on the stem 49.

A plurality of radially extending pressure sensing ports 65 are provided through the wall 66 of the valve body 47 below the level of the valve disc 40 to communicate the flowing pressure inside the shroud 25 to the interior space 66 adjacent the main bellows 56. The lower end of the main bellows 56 is sealingly connected to an inwardly directed shoulder 67 on the housing 68 of the sensor section 23. Located below the main bellows 56 is a bellows protection unit 70 of the general type described in U.S. Pat. No. 3,183,921, Garrett, also assigned to the assignee of this invention. The unit 70 includes an elongated rod 71 having its upper end slidably fitted within the lower portion 55 of the unlocking sleeve 54 and its lower end section 72 slidably disposed within a chamber 73. The chamber 73 is defined in part by spaced apart, oppositely facing valve seats 74 and 75 with the upper seat being engaged by an annular valve head 76 and seal 77 on the rod 71 in the uppermost position of the rod and the lower seat being engaged by the valve head and seal in the lowermost position on the rod. A fluid retaining bellows 78 is sealably connected to an annular member 79 which is threadedly fixed to the housing 68 and has its lower end fixed to a closure cap 80. The main bellows 56, the chamber 73 and the retaining bellows 78 provide an enclosed and sealed chamber space which is completely filled with an incompressible liquid. The rod 71 may be biased upwardly by a coil spring 81 positioned between the lower end of the rod and the ported transverse section 82 of the member 79.

The lower section 84 of the sensor housing 68 located adjacent and below the bellows 78 provides a dome which is charged to a preselected pressure value with a compressible fluid medium such as nitrogen gas through a charge port 85 that then is closed by a plug 86. A protective cap 87 may be threaded onto the lower end of the housing section 84.

The bellows protection unit 70 enables the sensor section 23 to be subjected to extreme well pressures, and the dome to be pressurized to a high set pressure, while still maintaining a low differential pressure across the main bellows 56, in the following manner. When flowing pressure acting through the sensing ports 65 predominates over dome pressure, bellows 56 will contract causing the rod 71 to move downwardly until the valve head 76 and seal 77 engage the lower valve seat 75. At this point, a portion of the incompressible liquid contained in the unit becomes trapped inside the bellows 56 so that a further increase in pressure will be transmitted only to the trapped liquid. On the other hand, when flowing pressures decrease below dome pressure, the main bellows 56 will elongate and allow the spring 81 to push the rod 71 upwardly until the valve head 76 and seal 77 engage the upper seat 74. A value of pressure equal to the dome pressure at the instant the valve head seats then is trapped inside the main bellows 56 and any further elongation of the bellows will relieve this hydraulic pressure, this protecting the bellows against high differential pressures.

An external flowing pressure falls below the preset dome pressure, as mentioned above, the bellows 56 extends and causes the unlocking sleeve 54 to shift upwardly, causing corresponding upward movement of the ball detent locking sleeve 48 and compression of the closing spring 57. At a point where a reduced diameter lower portion 89 of the sleeve 48 is positioned adjacent the ball detents 45, the detents are enabled to shift laterally inwardly and out of engagement with the internal groove 46 in the valve body 47. The closing spring 57 then snaps the valve disc 40 quickly upwardly against the valve seat ring 41 to close off the flow passage 42.

The valve disc 40 is reopened by an increase in external pressure which causes the main bellows 56 to contract. As the unlocking sleeve 54 shifts downwardly, the recocking spring 60 is compressed. When pressures are equalized across the valve disc 40, the spring 60 will drive the stem 49 and the attached disc downwardly until the ball detents 45 arrive opposite the recess 46, whereupon the locking sleeve spring 51 pushes it downwardly to reposition and lock the detents in the recess.

In operation, the interior of the pressure dome provided by the housing section 84 is charged with a compressible fluid such as nitrogen gas to a selected value which determines the flowing pressure at which the valve will close. When installation is made in a gas storage well, the dome setting would be toward the lower end of the expected bottom hole pressure range so that under normal production the valve will not close prematurely. Preferably the valve assembly 11 and packer 12 are installed in the casing 10 near the gas producing interval to provide protection to the full string of casing when the valve is closed.

It will be appreciated that the total of the gas production passing upwardly through the casing 10 must pass through the choke bean 29 which is located at the lower or entrance end of the shroud 25 and upstream of the valve inlet ports 33. The flow area or throat size of the choke 29 is designed for critical flow using appropriate parameters applicable for initial stages of production of the gas storage facility. Thus, at any time during the production cycle that the well flows abnormally or is free flowing, the flowing pressure downstream of the choke 29 will very rapidly fall to a value where a further decrease thereof does not increase the rate of gas flow. However, such downstream pressure, which then is the flowing pressure at the safety valve 21, can continue to drop rapidly to a value below the pressure setting of the dome 84.

When this occurs, the main bellows 56 will extend, carrying the unlocking sleeve 54 upwardly to compress the valve closing spring 57 and shift the locking sleeve 48 upwardly to a position where the ball detents 45 are released. Then the closing spring 57 snaps the valve disc 40 upwardly against the seat ring 41 to shut-off the gas flow. The disc 40 is held in such closed position by the upwardly acting pressure differential thereacross. With flow stopped, the pressure at the valve will increase to a pressure equal to bottom hole pressure, which causes the main bellows 56 to foreshorten and pull the unlocking sleeve 54 downwardly. Such movement compresses the recocking spring 60 and arms the valve to be reopened as soon as pressures across the valve disc 40 are equalized, which may be accomplished as soon as the surface damage has been repaired by pressurizing the casing 10.

It will be recognized that although the present invention is particularly adapted for use in gas storage wells or facilities, the concepts employed herein can have application to prolific, high volume oil wells where there is no significant immediate drawdown in bottom hole pressure even when the well is flowing freely. In this case the set pressure of the dome would be below but near the normal flowing pressure at the valve, and the flow restriction or choke 29 would not be sized for critical flow but rather for a magnitude of pressure drop sufficient to cause a "false" drawdown in flowing pressure under abnormal well flow conditions. The pressure drop at the valve would then fall below the dome pressure and cause the valve to shut-in the well.

A new and improved subsurface safety valve has been provided which is particularly suited for installation in gas storage facilities as well as other applications. Certain changes or modifications may be made in the disclosed embodiment without departing from the scope of the inventive concepts involved. For example, although the choke 29 preferably is located on a shroud 25 which directs the gas flow to the inlet ports 33 of the valve body 47, the flow restriction could be located on a separate assembly that is anchored or otherwise attached in the well conduit upstream of the valve assembly 11. Thus, it is the aim of the appended claims to cover all such changes or modifications falling within the true spirit and scope of the present invention.

We claim:

1. In combination with a safety valve apparatus provided with a dome reference pressure and valve means that is moved from open to closed position in response to a decrease in flowing pressure in a conduit adjacent said valve means to a value that is below said dome reference pressure, flow restriction means in said conduit upstream of said valve means for causing a drop in flowing pressure adjacent said valve means to a value that is below said dome reference pressure in response to abnormal conditions in said conduit downstream of said valve means.

2. A safety valve apparatus adapted to be installed at a subsurface location in a flow conduit, comprising: a valve body sealably anchored in said conduit, said body having a flow passage extending between inlet means and outlet means; valve means arranged for movement between an open position and a closed position with respect to said flow passage; means for moving said valve means from open to closed position including means providing a dome reference pressure and control means operating to move said valve means in response to a decrease in flowing pressure adjacent said valve means to a value that is below said dome reference pressure; tubular means connected to said valve body and arranged to direct the entire flow from a location upstream of said valve means to said inlet means; and flow restriction means on said tubular means for causing a drop in flowing pressure adjacent said valve means to a value that is below said dome reference pressure.

3. The apparatus of claim 2 wherein said flow conduit leads from a subterranean gas storge facility having a range of bottom hole pressures during withdrawal of gas therefrom, said flow restriction means having a throat area sized for critical flow at an upstream pressure selected with respect to initial stages of said withdrawal.

4. The apparatus of claim 3 wherein said dome reference pressure is set at a value near the lower end of said range of bottom hole pressures.

5. The apparatus of claim 4 wherein said valve means is positioned within said tubular means in laterally spaced relation thereto to provide an annular space for the passage of said gas along said valve means.

6. The apparatus of claim 5 further including means connected with said apparatus for providing an anchored pack-off in said well conduit.

7. A safety valve apparatus adapted to be installed at a subsurface location in a flow conduit leading from an underground gas storage reservior, comrpising: a valve body sealably anchored in said conduit, said body having a flow passage extending between inlet means and outlet means; valve means arranged for movement between open and closed positions with respect to said flow passage; means including a bellows control and a pressure charged reference pressure dome for closing said valve means in response to a drop in flowing pressure adjacent said control to a value that is below the reference pressure of said dome; an elongated tubular member having one end coupled to said valve body so as to direct the flow of gas to said inlet means, the other end of the tubular member being open; and choke means for restricting the flow of gas into said open end of said tubular member to provide a lesser pressure adjacent said control than in the well conduit upstream of said tubular member.

8. The apparatus of claim 7 wherein said tubular member surrounds said control whereby the flow of gas therethrough passes adjacent said control, and passage means for communicating the pressure of gas flowing in said tubular member with said control.

9. The apparatus of claim 8 wherein said choke means has a throat area sized for critical flow at a selected pressure upstream of said tubular member.

10. The apparatus of claim 7 further including means associated therewith providing an anchored packoff in a flow conduit.

* * * * *